US011231680B2

(12) United States Patent
Matsuo

(10) Patent No.: US 11,231,680 B2
(45) Date of Patent: Jan. 25, 2022

(54) IMAGE FORMING APPARATUS

(71) Applicant: CANON KABUSHIKI KAISHA, Tokyo (JP)

(72) Inventor: Makoto Matsuo, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/327,410

(22) Filed: May 21, 2021

(65) Prior Publication Data

US 2021/0373489 A1 Dec. 2, 2021

(30) Foreign Application Priority Data

May 29, 2020 (JP) ..... JP2020-094128

(51) Int. Cl.
*G03G 21/18* (2006.01)

(52) U.S. Cl.
CPC ..... *G03G 21/1839* (2013.01); *G03G 21/1803* (2013.01); *G03G 21/1857* (2013.01); *G03G 21/1825* (2013.01)

(58) Field of Classification Search
CPC ..... G03G 21/1857; G03G 21/186; G03G 21/1647; G03G 21/1825; G03G 21/1803
See application file for complete search history.

(56) References Cited

U.S. PATENT DOCUMENTS

2011/0097111 A1* 4/2011 Takayama ..... G03G 21/1633 399/124
2015/0139688 A1* 5/2015 Leemhuis ..... G03G 21/1676 399/110
2016/0221771 A1* 8/2016 Matsushima ..... B65H 1/266
2018/0037426 A1* 2/2018 Hyodo ..... G03G 15/6502
2019/0094768 A1* 3/2019 Shinoya ..... G03G 15/2028

FOREIGN PATENT DOCUMENTS

JP 5130308 B2 1/2013

* cited by examiner

*Primary Examiner* — Walter L Lindsay, Jr.
*Assistant Examiner* — Jessica L Eley
(74) *Attorney, Agent, or Firm* — Canon U.S.A., Inc. I.P. Division

(57) ABSTRACT

An image forming apparatus includes drum shafts supported by a main body, drum cartridges insertable and removable in an axial direction, a regulation side plate having bearings, a projecting portion provided to one of the regulation side plate and the main body, a fitting portion, and an urging force imparting portion. The urging force imparting portion is provided to the regulation side plate in an array direction of the bearings to impart an urging force that urges the regulation side plate toward the main body. At least a part of the urging force imparting portion is provided at a position for imparting the urging force on, with respect to the bearings, a side opposite to a position at which one of the projecting portion and the fitting portion is provided, in a direction orthogonal to the array direction of the bearings and the axial direction of each drum shaft.

17 Claims, 11 Drawing Sheets

IMAGE FORMING APPARATUS

BACKGROUND

Field

The present disclosure relates to an image forming apparatus including insertable/removable drum cartridges.

Description of the Related Art

In order to form a color image by an electrophotographic process, hitherto, there have been proposed a number of tandem-type image forming apparatus using toners of a plurality of colors such as yellow, magenta, cyan, and black. In the electrophotographic image forming apparatus, as many photosensitive drums as the number of colors to be used are arranged in parallel, and toner images formed of the respective colors are transferred in superimposition onto a recording medium (hereinafter referred to as "sheet") to form the color image. In order to suppress color misregistration of the toner images formed of the respective colors, the photosensitive drums are required to be positioned at high accuracy. In order to position the photosensitive drums at high accuracy, it is easy and effective to position the photosensitive drums by sandwiching the photosensitive drums between a side plate of an apparatus main body and a regulation side plate in which bearings for the respective photosensitive drums are provided at highly-accurate inter-bearing distances.

The photosensitive drum changes in characteristic by wearing or the like when image formation is continued for a long period. In order to prevent reduction in image quality due to the change in characteristic of the photosensitive drum, a user is required to regularly replace a drum cartridge including the photosensitive drum. Accordingly, it is required to configure the regulation side plate so as to be mountable to and removable from the main body so that the drum cartridge can be easily replaced. In Japanese Patent No. 5130308, the following configuration is disclosed. The regulation side plate including the bearings for the respective photosensitive drums is configured to be rotatable with respect to the side plate of the apparatus main body so as to allow easy access to the drum cartridge. Further, the regulation side plate includes hooks that can be engaged with the side plate of the apparatus main body so that, along with the rotation of the regulation side plate, the regulation side plate can be easily engaged (positioned) with respect to the apparatus main body.

However, when the regulation side plate is removed from the apparatus main body, a drum shaft having one end portion supported by the side plate on the rear side of the apparatus main body has another end portion tilted downward due to its own weight and the weight of the drum cartridge mounted to the drum shaft. Further, the drum shafts have different dimensions within a range of tolerance, and hence have differences in tilt amount. Accordingly, when the regulation side plate is to be mounted to the apparatus main body, a positioning portion provided to the regulation side plate and a fitting portion of the apparatus main body are positionally aligned to each other while the positions of the another end portions of the respective drum shafts are corrected by the respective bearings provided to the regulation side plate. At this time, when an axial direction of the bearing (direction in which the drum shaft is inserted through the bearing) passing through a center of a hole of the bearing is not matched with an axial direction of the drum shaft, the drum shaft and the bearing may be rubbed against each other to cause a resistance force. This resistance force is increased when the plurality of drum shafts are to be inserted through the plurality of bearings in a state in which the drum shafts are respectively tilted by different tilt amounts.

In Japanese Patent No. 5130308, a spring for urging the regulation side plate toward the apparatus main body side is provided at the same position as the positioning portion of the regulation side plate, thereby being capable of reducing the resistance force caused when the drum shaft and the bearing are positionally aligned to each other. The resistance force caused when the positioning portion provided to the regulation side plate and the fitting portion of the apparatus main body are positionally aligned to each other cannot be reduced. The user is required to press the regulation side plate against the apparatus main body with a force stronger than the resistance force caused when the positioning portion is positionally aligned to the fitting portion and an urging force for determining an axial position of the drum cartridge. In the configuration of Japanese Patent No. 5130308, the bearing, the positioning portion, and the spring are provided at the same position in a direction orthogonal to an array direction of the bearings and the axial direction of the drum shaft. Thus, when the user presses the regulation side plate against the apparatus main body, the regulation side plate is liable to tilt, and thus the work of mounting the regulation side plate to the apparatus main body is difficult.

SUMMARY

The present disclosure provides an image forming apparatus with which a regulation side plate configured to position drum shafts of a plurality of photosensitive drums can be easily fixed to an apparatus main body.

According to an aspect of the present disclosure, an image forming apparatus configured to form an image onto a recording medium includes an apparatus main body, a plurality of drum shafts supported by the apparatus main body, a plurality of drum cartridges where each drum cartridge includes a photosensitive drum and is insertable and removable in an axial direction of a corresponding one of the plurality of drum shafts, a regulation side plate which includes a plurality of bearings configured to support end portions of the plurality of drum shafts opposite to end portions of the plurality of drum shafts supported by the apparatus main body, and is to be fixed to the apparatus main body, a cam including a first contact surface and a second contact surface, an operation portion configured to rotatably operate the cam, a shaft which is rotatably provided to the regulation side plate, and to which the operation portion and the cam are fixed, a contact portion which is provided to the apparatus main body, and is configured to be brought into contact with the first contact surface and the second contact surface of the cam by rotation of the cam along with an operation of the operation portion, a projecting portion provided to one of the regulation side plate and the apparatus main body, a fitting portion which is provided to another one of the regulation side plate and the apparatus main body, and is to be fitted to the projecting portion, and an urging force imparting portion which is provided at each of both end portions of the regulation side plate in an array direction of the plurality of bearings, and is configured to impart, to the regulation side plate, an urging force that urges the regulation side plate toward the apparatus main body in a state in which the second contact surface is in contact with the contact portion by the operation portion being rotated by a user, wherein at least a part of the urging force imparting portion is provided at a position for imparting the urging force on, with respect to the plurality of bearings, a side opposite to a position at which one of the projecting portion and the fitting portion is provided, in a direction orthogonal to the array direction of the plurality of bearings and the axial direction of each of the plurality of drum shafts.

Further features of the present disclosure will become apparent from the following description of exemplary embodiments with reference to the attached drawings.

DESCRIPTION OF THE EMBODIMENTS (Image Forming Apparatus)

Figure 1:
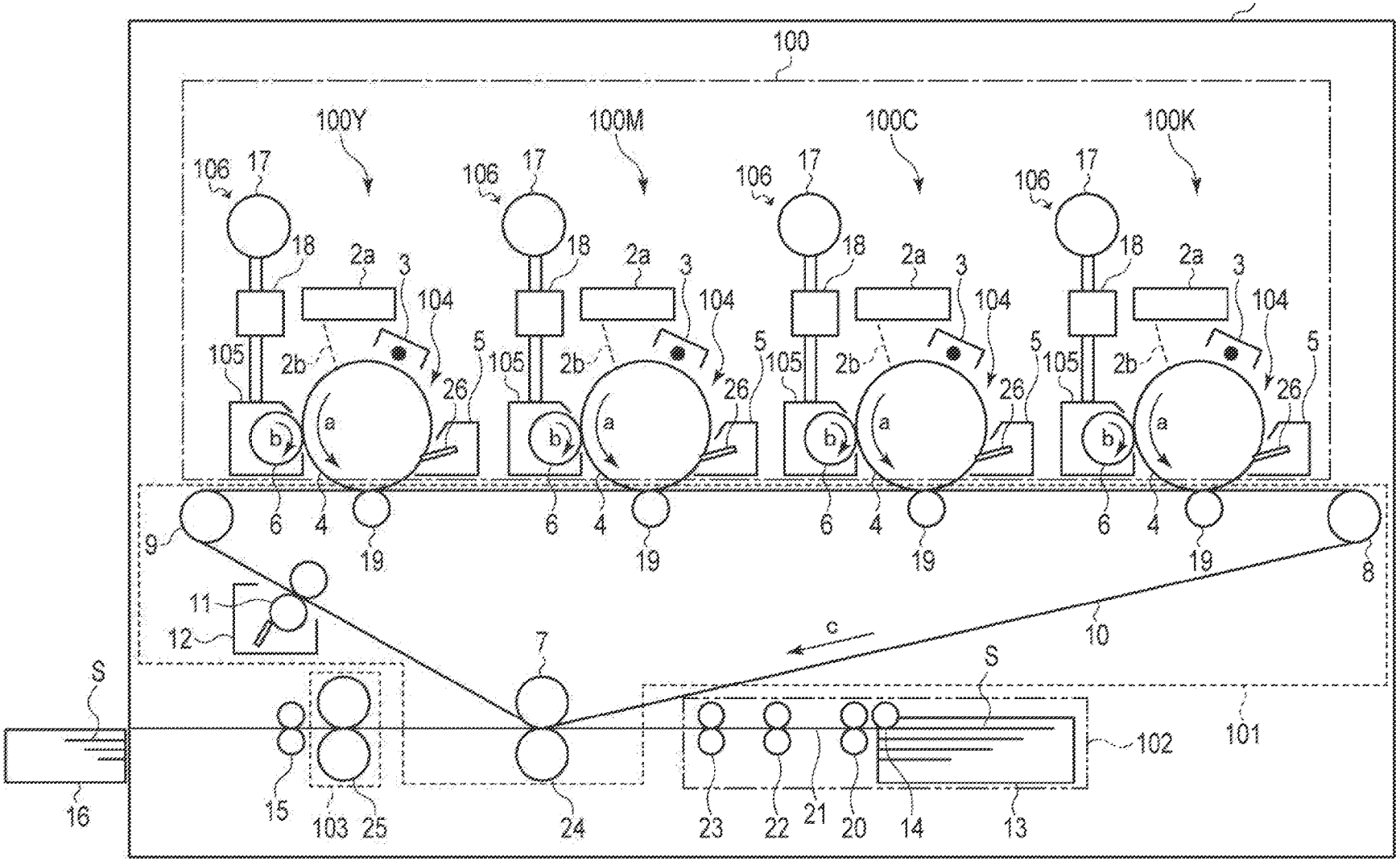
FIG. 1 is a view for illustrating an image forming apparatus.

FIG. 1 is a view for illustrating an image forming apparatus 1. The image forming apparatus 1 includes an image forming unit 100, a transfer portion 101, a sheet conveying portion 102, and a fixing portion 103. The image forming unit 100 includes a yellow image forming unit 100Y, a magenta image forming unit 100M, a cyan image forming unit 100C, and a black image forming unit 100K. The yellow image forming unit 100Y is configured to form a yellow toner image. The magenta image forming unit 100M is configured to form a magenta toner image. The cyan image forming unit 100C is configured to form a cyan toner image. The black image forming unit 100K is configured to form a black toner image.

The transfer portion 101 is configured to transfer the toner images of the respective colors formed by the yellow image forming unit 100Y, the magenta image forming unit 100M, the cyan image forming unit 100C, and the black image forming unit 100K onto a sheet (recording medium) S. The sheet conveying portion 102 is configured to convey the sheets S stored in a sheet storage 13 to the transfer portion 101. The fixing portion 103 is configured to fix the toner images to the sheet S.

The yellow image forming unit 100Y, the magenta image forming unit 100M, the cyan image forming unit 100C, and the black image forming unit 100K have substantially the same structure except for the color of the toner. Each of the yellow image forming unit 100Y, the magenta image forming unit 100M, the cyan image forming unit 100C, and the black image forming unit 100K includes a laser scanner unit 2*a*, a charging device 3, and a drum cartridge 104. The drum cartridge 104 includes a photosensitive drum 4 and a drum cleaning portion 5. The drum cartridge 104 is formed by integrating the photosensitive drum 4, the drum cleaning portion 5, and a drum container 47 into a cartridge, and is removably mounted to the image forming apparatus 1. The drum container 47 is configured to hold the photosensitive drum 4 and the drum cleaning portion 5.

The drum cartridge 104 is only required to be formed by integrating at least the photosensitive drum 4 and the drum container 47 configured to hold the photosensitive drum 4 into a cartridge, and be removably mounted to the image forming apparatus 1. Further, the drum cartridge 104 may be formed by integrating the photosensitive drum 4, the charging device 3, and the drum container 47 configured to hold the photosensitive drum 4 and the charging device 3 into a cartridge, and be removably mounted to the image forming apparatus 1. Further, the drum cartridge 104 may be formed by integrating the photosensitive drum 4, the charging device 3, the drum cleaning portion 5, and the drum container 47 into a cartridge, and be removably mounted to the image forming apparatus 1.

Each of the yellow image forming unit 100Y, the magenta image forming unit 100M, the cyan image forming unit 100C, and the black image forming unit 100K further includes a developing cartridge 105 and a replenishing portion 106. The developing cartridge 105 includes a developing roller 6. The replenishing portion 106 is configured to supply toner to the developing cartridge 105. The transfer portion 101 includes an intermediate transfer belt 10 serving as an intermediate transfer member. The intermediate transfer belt 10 is stretched by a secondary transfer inner roller 7, a tensioning roller 8, and a drive roller 9, and is configured to rotate in a rotating direction "c". A transfer cleaning portion 12 configured to bring a cleaning member 11 into abutment against a surface of the intermediate transfer belt 10 is provided. In the sheet conveying portion 102, the sheet storage 13 and a pickup roller 14 are provided. The sheet storage 13 is configured to store the sheets S, and is freely mountable to and removable from the image forming apparatus 1. The pickup roller 14 serves as a sheet feeding unit configured to feed the sheets S stored in the sheet storage 13. On the downstream of the fixing portion 103 in a printing process, a delivery roller pair 15 and a stacking portion 16 are provided. The delivery roller pair 15 is configured to deliver the sheets S. The stacking portion 16 is provided at the outside of the image forming apparatus 1 or in a subsequent post-processing unit (not shown), and is configured to stack the sheets S.

Next, an image forming operation of the image forming apparatus 1 is described. When image data is transmitted to the image forming apparatus 1, a control signal from a controller (not shown) causes laser light 2*b* corresponding to an image to irradiate a surface of the photosensitive drum 4 rotating in a rotating direction "a". At this time, the photosensitive drum 4 is charged by the charging device 3 in advance, and is irradiated with light to form an electrostatic latent image. The replenishing portion 106 includes a toner bottle 17 and an agitating portion 18. Toner is conveyed from the toner bottle 17 into the developing cartridge 105 via the agitating portion 18. While being held on the surface of the developing roller 6 rotating in the rotating direction "b", the toner develops the electrostatic latent image formed on the photosensitive drum 4, and thus the toner image is formed on the photosensitive drum 4.

The toner image formed as described above is primarily transferred onto an outer periphery of the intermediate transfer belt 10 through pressure applied by a primary transfer roller 19 arranged so as to be opposed to the photosensitive drum 4 on the inner side of the intermediate transfer belt 10. Thus, the toner image is formed on the intermediate transfer belt 10. When a feed signal is output from the controller (not shown) to the sheet conveying portion 102, the sheets S are fed by the pickup roller 14 from the sheet storage 13 serving as a sheet storing portion. A separation roller pair 20 separates one uppermost sheet S of the fed sheets S. The separated sheet S is conveyed through a conveyance path 21 by a conveyance roller pair 22 to reach a registration roller pair 23. Skew feeding of the sheet S is corrected by the registration roller pair 23 serving as a skew-feeding correcting portion. The registration roller pair 23 starts to convey the sheet S so that a leading edge of the toner image formed on the intermediate transfer belt 10 is matched with a leading edge of the sheet S, and conveys the sheet S to a nip portion between the secondary transfer inner roller 7 and a secondary transfer outer roller 24 of the transfer portion 101.

The toner images formed on the intermediate transfer belt 10 are conveyed to the nip portion between the secondary transfer inner roller 7 and the secondary transfer outer roller 24 by the intermediate transfer belt 10 rotated by the drive roller 9 in the rotating direction "c". At the nip portion between the secondary transfer inner roller 7 and the secondary transfer outer roller 24, the toner images formed on the intermediate transfer belt 10 are transferred onto the sheet S conveyed by the registration roller pair 23. The sheet S having the toner images transferred thereon is conveyed to the fixing portion 103. In the fixing portion 103, the sheet S is heated and pressed by a fixing roller pair 25 to fix the toner images to the sheet S. Thus, an image is formed on the sheet S. The sheet S having the image formed thereon is delivered to the stacking portion 16 by the delivery roller pair 15.

The toner remaining on the photosensitive drum 4 after the primary transfer is scraped off by a cleaning member 26 to be collected into the drum cleaning portion 5. The toner remaining on the intermediate transfer belt 10 after the secondary transfer is scraped off by the cleaning member 11 to be collected into the transfer cleaning portion 12. The residual toner collected into the drum cleaning portion 5 and the transfer cleaning portion 12 passes through a toner conveyance path (not shown) to be collected into a residual toner collecting container (not shown).

(Regulation Side Plate Unit)

Figure 2A:
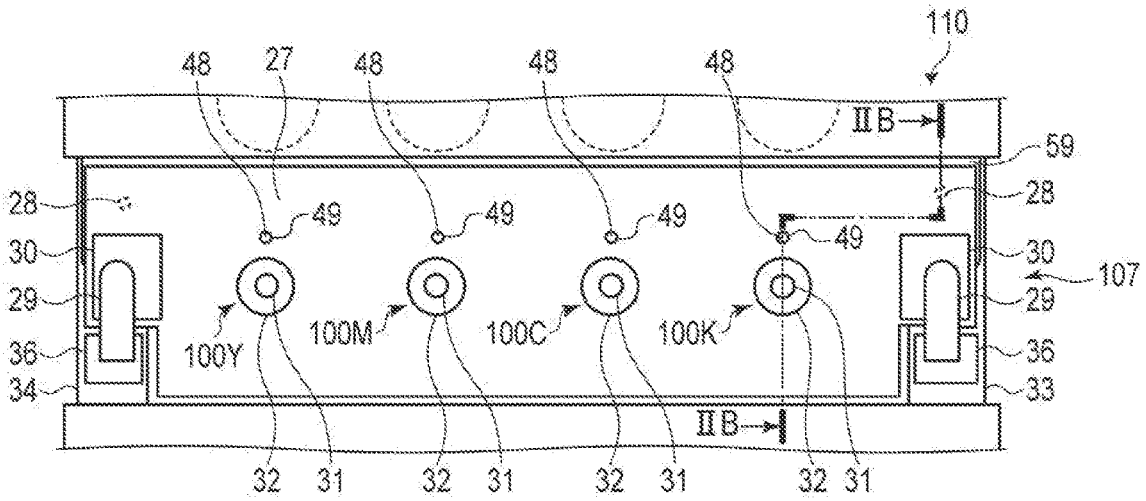
FIG. 2A and FIG. 2B are views for illustrating a regulation side plate unit fixed to an apparatus main body.
Figure 2B:
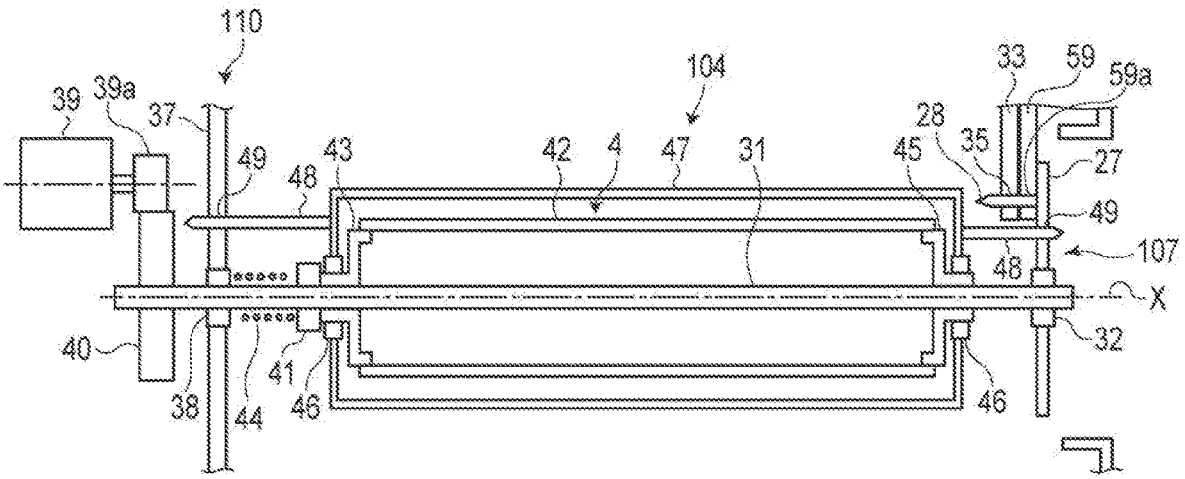

FIG. 2A and FIG. 2B are views for illustrating a regulation side plate unit 107 fixed to an apparatus main body 110. In this embodiment, among the structures of the image forming apparatus 1, a support frame member configured to support each unit is referred to as "apparatus main body 110." When the regulation side plate unit 107 is fixed to the apparatus main body 110, a plurality of drum cartridges 104 are positioned with respect to the apparatus main body 110. FIG. 2A is a front view of the regulation side plate unit 107 fixed to the apparatus main body 110. FIG. 2B is a sectional view of the drum cartridge 104 of the black image forming unit 100K taken along the line IIB-IIB of FIG. 2A. In the following description, a front side or the front of the apparatus main body 110 refers to a side of the image forming apparatus 1 on which an opening/closing door (not shown) is arranged. In this case, the opening/closing door refers to a door to be opened when the above-mentioned drum cartridge 104 is inserted or removed or when a different unit is subjected to maintenance. A rear side refers to a side opposite to the front side or the front. A front-and-rear direction refers to a direction directed from the rear to the front (forward direction), and a direction opposite thereto (rearward direction). A right or a left refers to the right or the left when the image forming apparatus is viewed from the front side. A right-and-left direction refers to a direction directed from the right to the left (left direction), and a direction opposite thereto (right direction). The right-and-left direction corresponds to a width direction of the image forming apparatus 1.

As illustrated in FIG. 2B, the photosensitive drum 4 includes a drum blank pipe 42, a front flange 45, and a rear flange 43. The front flange 45 is mounted to a front end portion of the drum blank pipe 42. The rear flange 43 is mounted to a rear end portion of the drum blank pipe 42. The drum cartridge 104 can be inserted into and removed from the image forming apparatus 1 in a drum axial direction X. As illustrated in FIG. 2A, the image forming apparatus 1 includes a right support column 33, a left support column 34, and a front side plate 59 connecting between the right support column 33 and the left support column 34. The right support column 33, the left support column 34, and the front side plate 59 form a part of the front side of the main-body frame member of the apparatus main body 110.

The regulation side plate unit 107 includes a regulation side plate 27, two projecting portions (positioning portions) 28, two lever portions 30, and four front drum bearings 32. The two projecting portions 28 are respectively fixed to a left end portion and a right end portion of the regulation side plate 27. The two lever portions 30 are respectively provided at the left end portion and the right end portion of the regulation side plate 27. Each of the two lever portions 30 is configured to rotatably hold a lever 29 serving as a handle (gripping portion). The four front drum bearings 32 are arranged between the two lever portions 30. The four front drum bearings 32 respectively support front end portions (end portions opposite to end portions supported by the apparatus main body 110) of four drum shafts 31 provided to the apparatus main body 110.

Figure 4A:
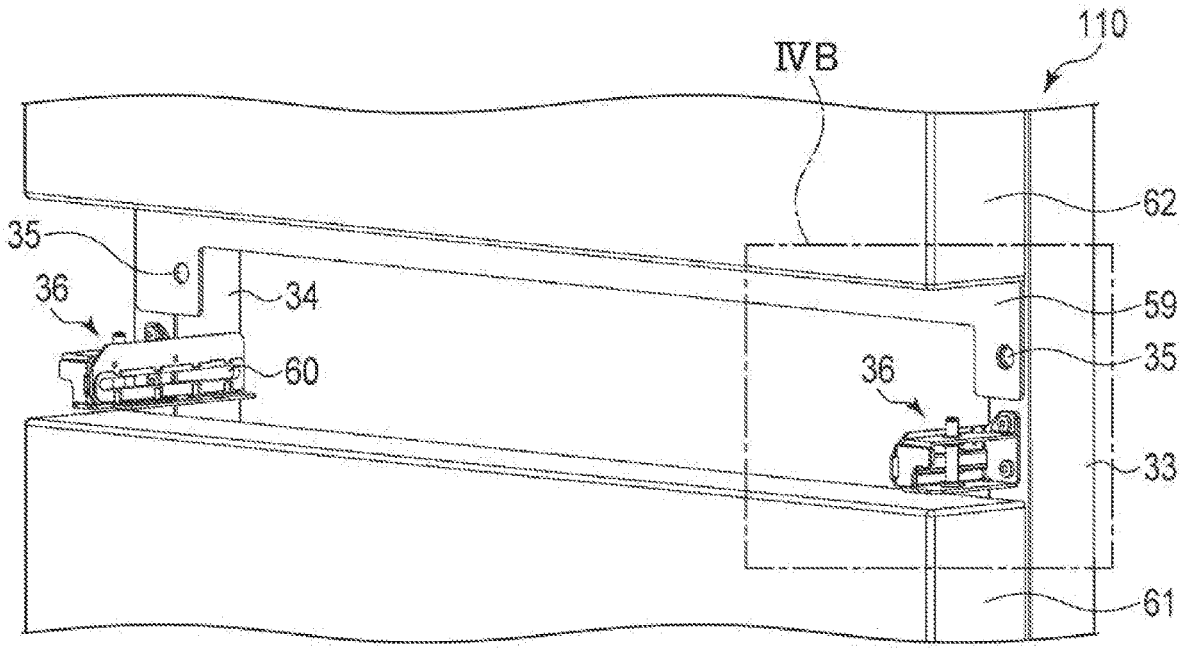
FIG. 4A and FIG. 4B are views for illustrating a support base portion fixed to the apparatus main body.

In the right support column 33, a positioning hole (fitting portion) 35 is formed. In the front side plate 59, a positioning hole (fitting portion) 35 is formed in the vicinity of the left support column 34 (FIG. 4A). In the front side plate 59, a hole 59*a* for allowing the projecting portion 28 to pass therethrough is formed at a position corresponding to the positioning hole 35 of the right support column 33. The two projecting portions 28 fixed to the regulation side plate 27 are respectively fitted to the positioning hole 35 formed in the right support column 33 as the fitting portion and the positioning hole 35 formed in the front side plate 59, to thereby determine the position of the regulation side plate 27 in an up-and-down direction and the right-and-left direction of the apparatus main body 110. A support base portion (support portion) 36 is fixed to each of the right support column 33 and the left support column 34. The lever portion 30 is configured to be engaged with the support base portion 36 to urge the regulation side plate unit 107 toward the rear side of the apparatus main body 110 and bring the regulation side plate 27 into contact with the front side plate 59, to thereby determine the position in the front-and-rear direction of the regulation side plate 27 with respect to the apparatus main body 110.

In this embodiment, the projecting portions 28 are formed on the regulation side plate 27 of the regulation side plate unit 107, and the positioning holes 35 are formed in the apparatus main body 110. However, the projecting portions (positioning portions) 28 may be formed on the apparatus main body 110, and the positioning holes (fitting portions) 35 may be formed in the regulation side plate 27. When the projecting portions 28 are fitted to the positioning holes 35 serving as the fitting portions, similarly, the regulation side plate 27 is positioned in the up-and-down direction and the right-and-left direction with respect to the apparatus main body 110.

On the rear side of the apparatus main body 110, a rear side plate 37 is provided. The rear side plate 37 has a plurality of rear drum bearings (main-body support portions) 38 provided thereto. Rear end portions of the plurality of drum shafts 31 are rotatably supported by the plurality of rear drum bearings 38, respectively. When the regulation side plate unit 107 is mounted to the apparatus main body 110, the plurality of front drum bearings (plurality of bearings) 32 respectively support the front end portions of the plurality of drum shafts 31 on the opposite side of the rear end portions of the plurality of drum shafts 31 supported by the plurality of rear drum bearings 38.

When the regulation side plate 27 is positioned with respect to the apparatus main body 110, the plurality of front drum bearings 32 fixed at a plurality of predetermined positions of the regulation side plate 27 are positioned. The rear end portions of the plurality of drum shafts 31 are respectively supported by the rear drum bearings 38 held by the rear side plate 37 at equal intervals, and are positioned on the rear side of the apparatus main body 110. A drum gear 40 is fixed to each of the rear end portions of the drum shafts 31. The drum gear 40 meshes with a gear 39*a* of a drive motor 39. The drive motor 39 is configured to rotate the drum shaft 31 in a predetermined direction. On the drum shaft 31, a coupling 41 which is rotatable together with the drum shaft 31 is mounted. The coupling 41 is movable in the drum axial direction X.

A coupling spring (elastic member) 44 serving as an urging member is provided between the rear drum bearing 38 and the coupling 41. The coupling spring 44 is configured to urge the coupling 41 against the rear flange 43 fixed to the rear end portion of the drum blank pipe 42. When the coupling 41 is coupled to the rear flange 43, a drive force of the drive motor 39 is transmitted to the drum blank pipe 42 to rotate the drum blank pipe 42.

The drum shaft 31 is fitted to the front flange 45 fixed to the front end portion of the drum blank pipe 42 and the rear flange 43 fixed to the rear end portion of the drum blank pipe 42, to thereby position the photosensitive drum 4. The drum container 47 serving as a casing of the drum cartridge 104 has flange bearings 46 respectively provided at a front end portion and a rear end portion thereof. The flange bearings 46 are respectively fitted to the front flange 45 and the rear flange 43. In this manner, the drum container 47 rotatably supports the photosensitive drum 4.

The drum container 47 has rotation stop shafts 48 respectively provided at both end portions in a longitudinal direction of the drum container 47. The drum shaft 31 is caused to pass through the photosensitive drum 4, and the rotation stop shafts 48 are respectively fitted to positioning holes 49 formed in the rear side plate 37 and the regulation side plate 27. In this manner, the drum cartridge 104 is positioned with respect to the apparatus main body 110. When the coupling spring 44 urges the drum container 47 toward the front side so that an abutment portion (not shown) of the drum container 47 abuts against the regulation side plate unit 107, the drum cartridge 104 is positioned in the drum axial direction X.

Figure 3A:
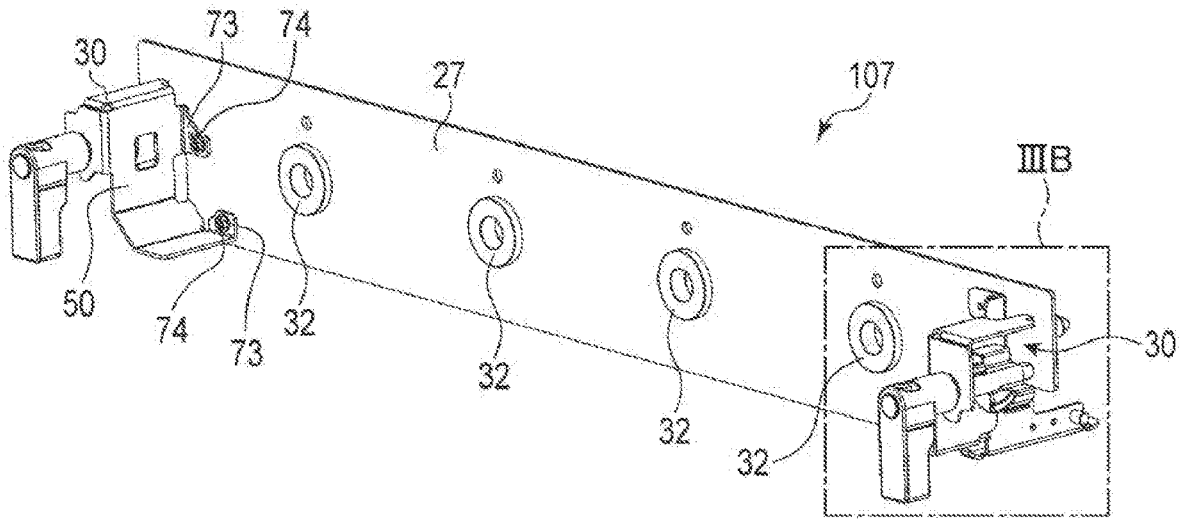
FIG. 3A and FIG. 3B are views for illustrating the regulation side plate unit.
Figure 3B:
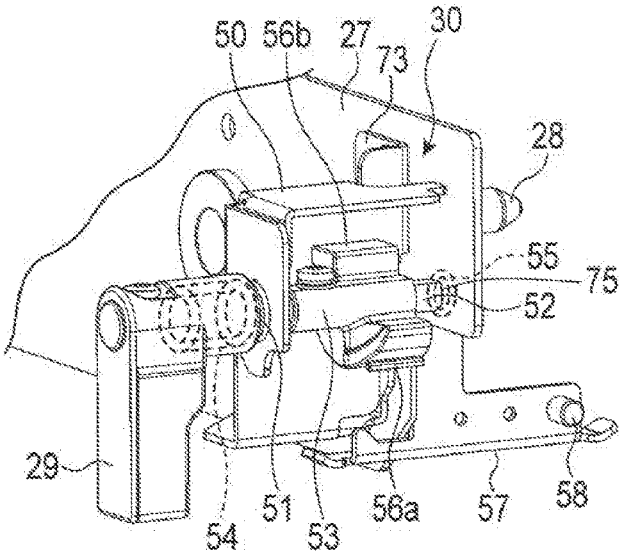

FIG. 3A and FIG. 3B are views for illustrating the regulation side plate unit 107. FIG. 3A is a perspective view of the regulation side plate unit 107. FIG. 3B is an enlarged view of a part IIIB surrounded by the long dashed short dashed line of FIG. 3A. FIG. 3B is an illustration of the right lever portion 30. The left lever portion 30 has a structure substantially bilaterally-symmetric to the right lever portion 30, and hence an enlarged view of the left lever portion 30 is omitted. On the regulation side plate 27 of the regulation side plate unit 107, the front drum bearings 32 are arrayed as many as the number of colors to be used for image formation (four in this embodiment). The lever portions 30 are respectively provided at both end portions of the regulation side plate 27 in an array direction (drum array direction) of the plurality of front drum bearings 32. Further, the regulation side plate unit 107 includes a motor and a gear train including a coupling which are configured to transmit drive to the developing cartridge 105.

When the drum cartridge 104 and the developing cartridge 105 are inserted into the image forming apparatus 1, the drum cartridge 104 and the developing cartridge 105 receive an urging force from the apparatus main body 110. The drum cartridge 104 and the developing cartridge 105 receiving the urging force impart a resistance force to the regulation side plate 27 in a direction of separating the regulation side plate 27 away from the apparatus main body 110. Further, when the projecting portion 28 of the regulation side plate 27 is fitted to the positioning hole 35 of the apparatus main body 110, a contact resistance caused when the projecting portion 28 in a tilted state is fitted to the positioning hole 35 causes a resistance force to be imparted to the regulation side plate 27 in the direction of separating the regulation side plate 27 away from the apparatus main body 110. In order to press the regulation side plate 27 against the apparatus main body 110 against those resistance forces, the lever portions 30 provided at both end portions of the regulation side plate 27 are used to press and position the regulation side plate unit 107 with respect to the apparatus main body 110 without one side coming off.

(Lever Portion)

The lever portion 30 includes a support plate 50, a lever bearing 51, a lever shaft 52, a lever cam 53, a compression spring (elastic member) 54, and the lever 29. The support plate 50 includes at least one support plate fixing portion 73. In this embodiment, two support plate fixing portions 73 are fixed to the regulation side plate 27 by screws 74. In this manner, the support plate 50 is fixed to the regulation side plate 27. The lever bearing 51 is mounted to the support plate 50. The lever shaft 52 is held by the lever bearing 51 mounted to the support plate 50 and a hole 75 formed in the regulation side plate 27, so as to be rotatable and also movable in a longitudinal direction of the lever shaft 52. The lever 29 and the lever cam 53 are fixed to the lever shaft 52.

The compression spring 54 serving as an urging member is held between the lever 29 and the lever bearing 51 coaxially with the lever shaft 52. The compression spring 54 is configured to urge the lever 29 in the forward direction of the apparatus main body 110 to urge the lever shaft 52 in the forward direction of the apparatus main body 110. A stopper member 55 serving as a restraint tool is mounted to a rear end portion of the lever shaft 52. When the lever shaft 52 is moved in the forward direction by the urging force of the compression spring 54, the stopper member 55 abuts against the regulation side plate 27, to thereby prevent the lever shaft 52 from falling out of the hole 75 of the regulation side plate 27.

The lever 29 is rotatable with respect to the regulation side plate 27 about the lever shaft 52. The lever cam 53 includes a first abutment portion 56*a* and a second abutment portion 56*b*. With the first abutment portion 56*a* and the second abutment portion 56*b* abutting against the support plate 50, a range of a rotation angle of the lever 29 is regulated. In this embodiment, the first abutment portion 56*a* and the second abutment portion 56*b* serving as an angle regulating portion configured to regulate the range of the rotation angle of the lever 29 are provided to the lever cam 53. However, the angle regulating portion may be provided to the lever shaft 52 or the lever 29. For example, the angle regulating portion provided to the lever shaft 52 may be brought into abutment against the support plate 50 or the regulation side plate 27. Further, the angle regulating portion provided to the lever 29 may be brought into abutment against the support plate 50.

In the regulation side plate 27, a guide portion 57 is provided in the vicinity of the lever portion 30. The guide portion 57 has a holding shaft 58 provided thereto. When the user mounts or removes the regulation side plate unit 107 to or from the apparatus main body 110, the guide portion 57 and the holding shaft 58 roughly regulate the position of the regulation side plate unit 107 with respect to the apparatus main body 110, to thereby assist the operation of the user.

(Support Base Portion)

Figure 4B:
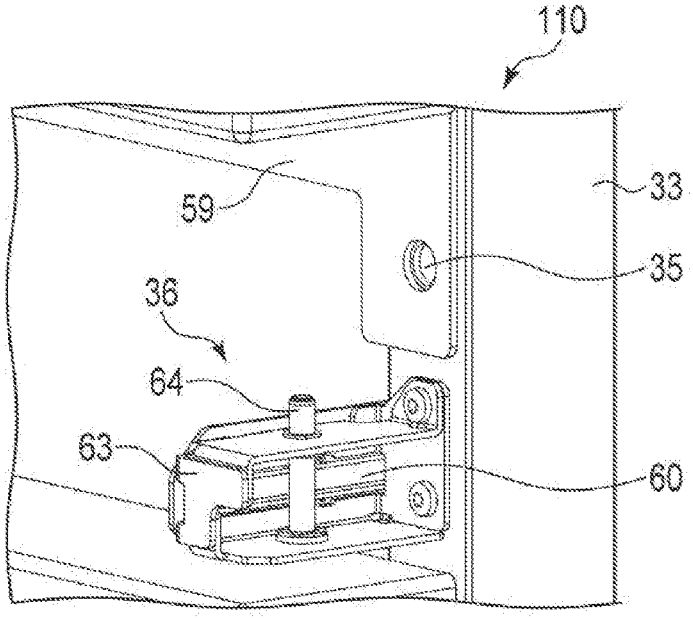

FIG. 4A and FIG. 4B are views for illustrating the support base portion 36 fixed to the apparatus main body 110. FIG. 4A is a perspective view for illustrating the support base portions 36 fixed to the apparatus main body 110. FIG. 4B is an enlarged view of a part IVB surrounded by the long dashed short dashed line of FIG. 4A. FIG. 4B is an illustration of the right support base portion 36. The left support base portion 36 has a structure substantially bilaterally-symmetric to the right support base portion 36, and hence an enlarged view of the left support base portion 36 is omitted. The front side of the apparatus main body 110 is formed of the right support column 33, the left support column 34, and the front side plate 59 connecting between the right support column 33 and the left support column 34. In this embodiment, the positioning hole 35 for the regulation side plate unit 107 is formed in the right support column 33 on the right side of the image forming apparatus 1, and is also formed in the front side plate 59 on the left side of the image forming apparatus 1.

The support base portion 36 includes a support base 63, a contact portion 64, and a guide groove 60. The contact portion 64 can be brought into contact with the lever cam 53 of the lever portion 30. The contact portion 64 is rotatably held by the support base 63. The contact portion 64 is rotatable about a rotation axis extending in the up-and-down direction orthogonal to the front-and-rear direction and the right-and-left direction of the image forming apparatus 1. However, the contact portion 64 may be formed of a part of the support base 63 or a block-shaped separate member. In this case, it is preferred that the part of the support base 63 or the block-shaped separate member project in the up-and-down direction orthogonal to the front-and-rear direction and the right-and-left direction of the image forming apparatus 1.

The guide groove 60 is configured to guide the regulation side plate unit 107 inserted into or removed from the apparatus main body 110. Two support base portions 36 are respectively fixed to the right support column 33 and the left support column 34 so that the guide grooves 60 of the two support base portions 36 face each other. The guide groove 60 extends in the front-and-rear direction of the apparatus main body 110. The image forming apparatus 1 has an openable/closable transfer-portion inner-side cove 61 provided thereto. The transfer-portion inner-side cover 61 covers an opening portion through which the transfer portion 101 is mounted and removed. The image forming apparatus 1 has an openable/closable toner-bottle inner-side cover 62 provided thereto. The toner-bottle inner-side cover 62 covers an opening portion through which the toner bottle 17 is mounted and removed. The support base portions 36 are provided on the outer side of an open/close region of the transfer-portion inner-side cover 61, an open/close region of the toner-bottle inner-side cover 62, and an insertion/removal region of the regulation side plate unit 107.

(Lever Cam)

Figure 5A:
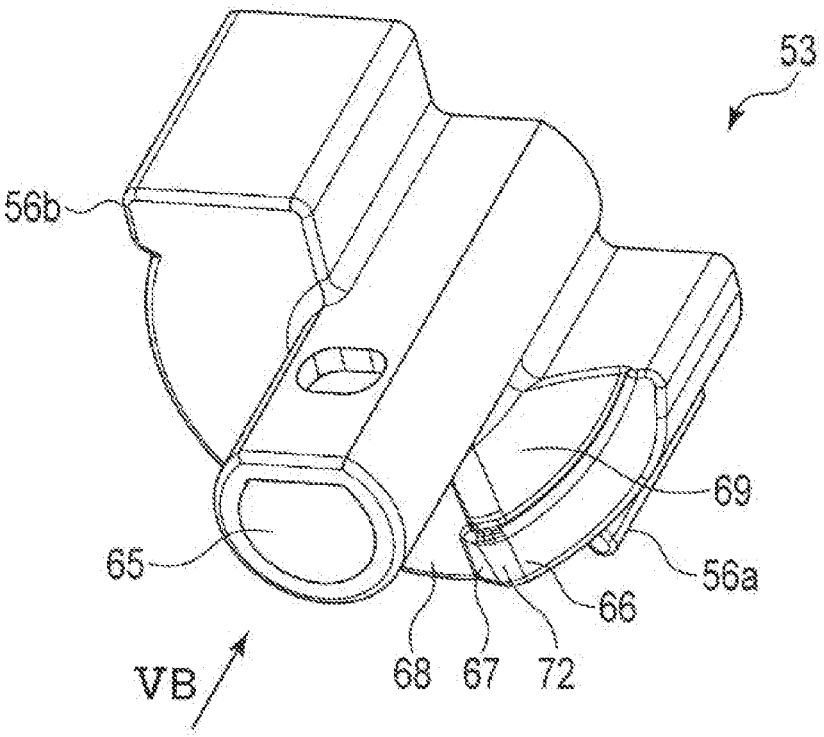
FIG. 5A and FIG. 5B are views for illustrating a lever cam.
Figure 5B:
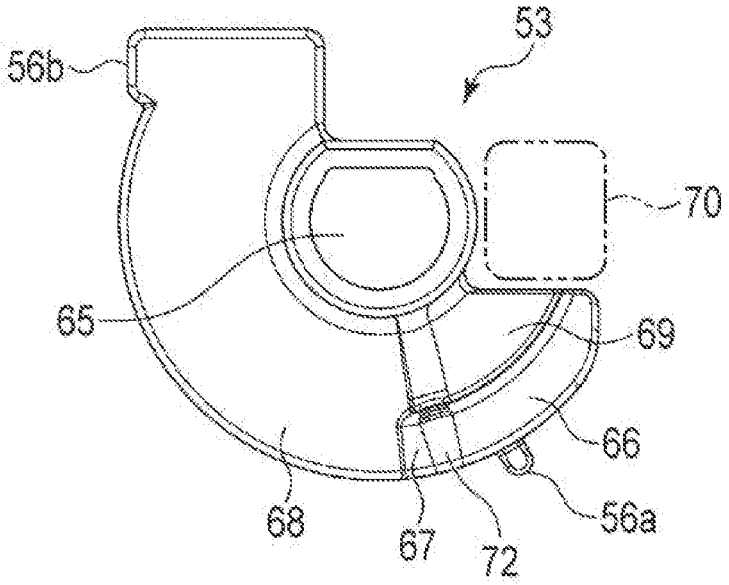

FIG. 5A and FIG. 5B are views for illustrating the lever cam 53. FIG. 5A is a perspective view of the lever cam 53 to be used for the right lever portion 30 of the image forming apparatus 1. FIG. 5B is a view as viewed along the arrow VB of FIG. 5A. At a center portion of the lever cam 53, a coupling portion 65 to be coupled to the lever shaft 52 is provided. The lever cam 53 has, in a front surface around the coupling portion 65, a first contact surface 66, an engagement surface 67, and a second contact surface 68. The first contact surface 66 is a clockwise helical surface inclined from the rear side toward the front side, and can be brought into abutment against the contact portion 64. The engagement surface 67 is connected to the first contact surface 66 by a connecting portion (intersection) 72, and has an inclination in an opposite direction to that of the first contact surface 66. The engagement surface 67 is connected to the second contact surface 68. The second contact surface 68 is brought into contact with the contact portion 64 when the user performs the rotation operation of the lever 29 to fix the regulation side plate unit 107 to the apparatus main body 110.

The lever cam 53 has a retreat surface 69 which is lowered by one step toward the rear side from the first contact surface 66, on an inner side with respect to the first contact surface 66 in a radial direction from the rotation center of the lever shaft 52. The retreat surface 69 is not brought into contact with the contact portion 64. Further, the lever cam 53 has a contact relief portion 70 adjacent to the first contact surface 66 in the counterclockwise direction from the first contact surface 66 on a side opposite to the second contact surface 68 with respect to the first contact surface 66. The contact relief portion 70 is retreated from the first contact surface 66 in an axial direction of the coupling portion 65. On the outer periphery of the lever cam 53, in order to regulate the range of the rotation angle of the lever 29, the first abutment portion 56*a* and the second abutment portion 56*b* are provided.

In this embodiment, the first contact surface 66 to be brought into contact with the contact portion 64 is formed into a helical surface. However, as long as the first contact surface 66 can be smoothly brought into contact with the contact portion 64, the first contact surface 66 may be a linear flat surface or an arc-shaped surface. The lever cam 53 to be used for the left lever portion 30 of the apparatus main body 110 has a shape bilaterally-symmetric to that of the right lever portion 30 of the apparatus main body 110 illustrated in FIG. 5A and FIG. 5B, and hence description thereof is omitted.

(Operation of Replacing Drum Cartridge)

Figure 6A:
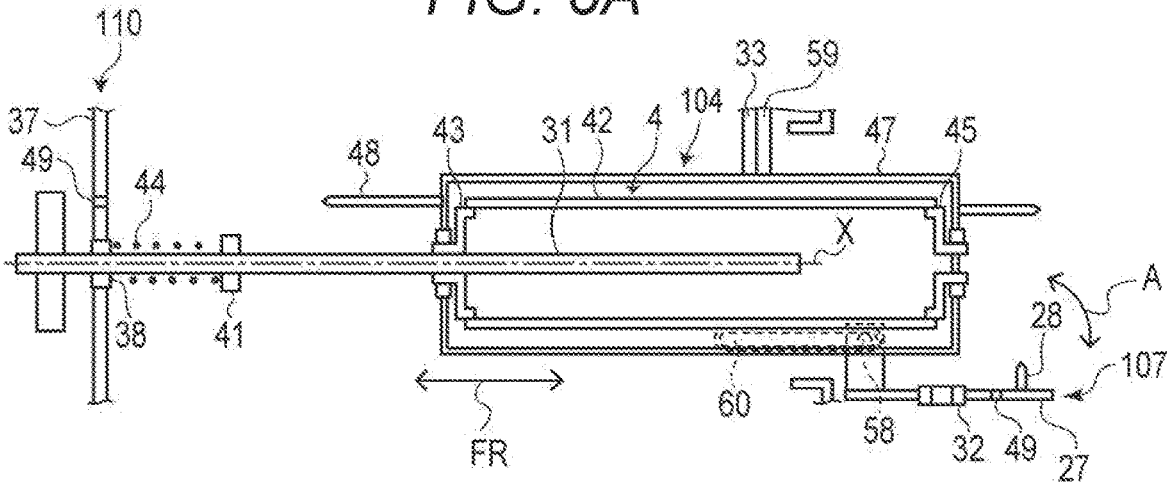
FIG. 6A, FIG. 6B, and FIG. 6C are explanatory views for illustrating an operation of replacing a drum cartridge.
Figure 6B:
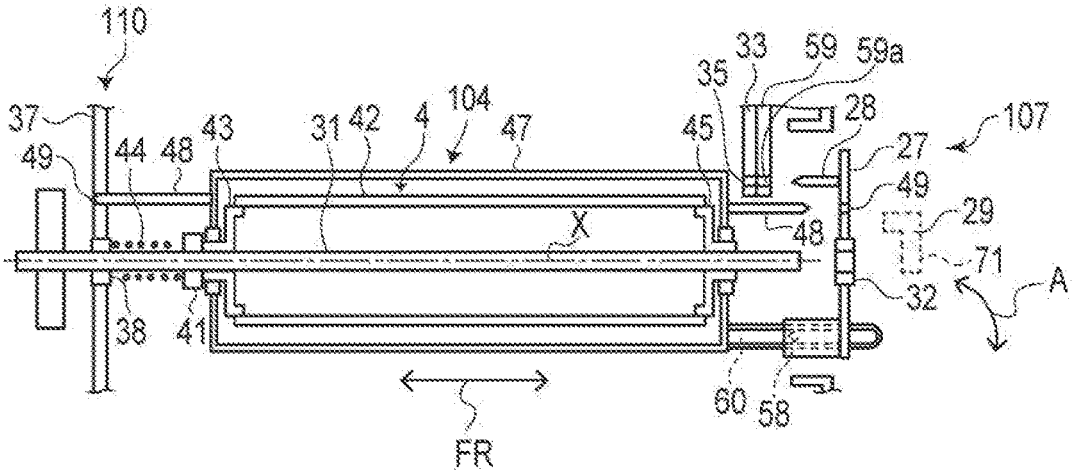
Figure 6C:
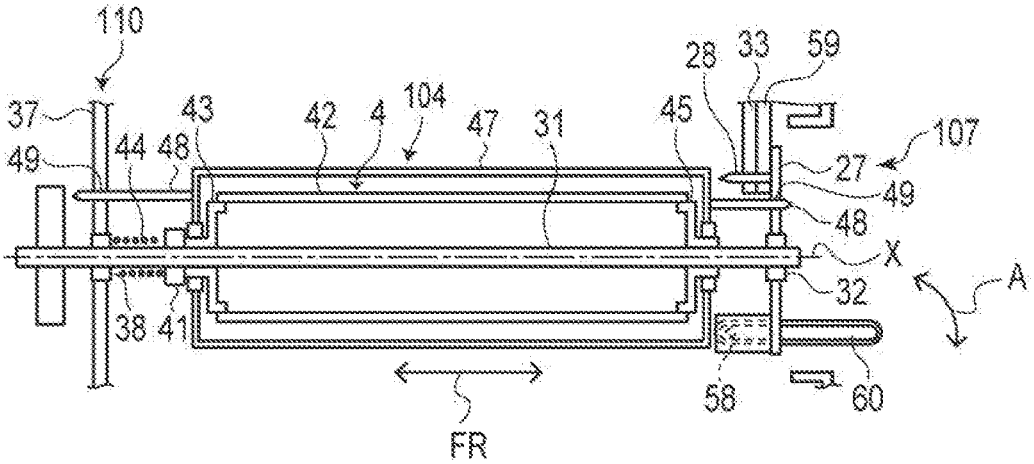

FIG. 6A, FIG. 6B, and FIG. 6C are explanatory views for illustrating an operation of replacing the drum cartridge 104.

FIG. 6A, FIG. 6B, and FIG. 6C are sectional views of the drum cartridge 104 taken along the line IIB-IIB of FIG. 2A similarly to FIG. 2B. With reference to FIG. 6A, FIG. 6B, and FIG. 6C, an operation of mounting the drum cartridge 104 to the apparatus main body 110 is described. The holding shafts 58 provided at both end portions of the regulation side plate unit 107 are respectively inserted into the guide grooves 60 formed in the support base portions 36 fixed to the right and left sides of the apparatus main body 110. The holding shafts 58 are held by the guide grooves 60 so as to be movable in a front-and-rear direction FR of the apparatus main body 110 and also rotatable in a rotation direction A with respect to the apparatus main body 110. The regulation side plate unit 107 is rotatable with respect to the apparatus main body 110 with the holding shafts 58 serving as rotation centers.

In a state in which the engagement between the lever portion 30 and the support base portion 36 is canceled, the regulation side plate unit 107 is movable toward the front side in the drum axial direction X while the holding shafts 58 are guided by the guide grooves 60. The regulation side plate unit 107 is rotated toward the front side in the rotation direction A with the holding shafts 58 serving as the rotation centers when the holding shafts 58 are located at front end portions or the vicinity thereof of the guide grooves 60, and is held at the position illustrated in FIG. 6A. The user can remove the used drum cartridge 104 from the apparatus main body 110. The position of the regulation side plate unit 107 with respect to the apparatus main body 110 in FIG. 6A corresponds to a disengagement position at which the drum bearing 32 is separated from the drum shaft 31 and thus the drum cartridge 104 is insertable or removable.

When the used drum cartridge 104 is removed from the apparatus main body 110, the drum shaft 31 is supported in a cantilever state by the rear drum bearing 38 held by the rear side plate 37 of the apparatus main body 110. In a state in which the regulation side plate unit 107 is held at the position illustrated in FIG. 6A, the user fits the rear flange 43 and the front flange 45 of a new drum cartridge 104 to the drum shaft 31, and inserts the drum cartridge 104 toward the rear side of the apparatus main body 110.

As the drum cartridge 104 is gradually inserted toward the rear side of the apparatus main body 110, as illustrated in FIG. 6B, the coupling 41 held by the drum shaft 31 meshes with the rear flange 43. The coupling 41 is urged toward the front side of the apparatus main body 110 by the coupling spring (compression spring) 44 serving as the urging member. As the drum cartridge 104 is gradually inserted toward the rear side of the apparatus main body 110, the drum cartridge 104 receives a reaction force from the coupling 41 by the urging force of the coupling spring 44. The user can push in the drum cartridge 104 against the urging force of the coupling spring 44 until the rotation stop shaft 48 reaches a position at which the rotation stop shaft 48 is fitted to the positioning hole 49 of the rear side plate 37 or a position at which the rotation stop shaft 48 comes close to the positioning hole 49.

Figure 7A:
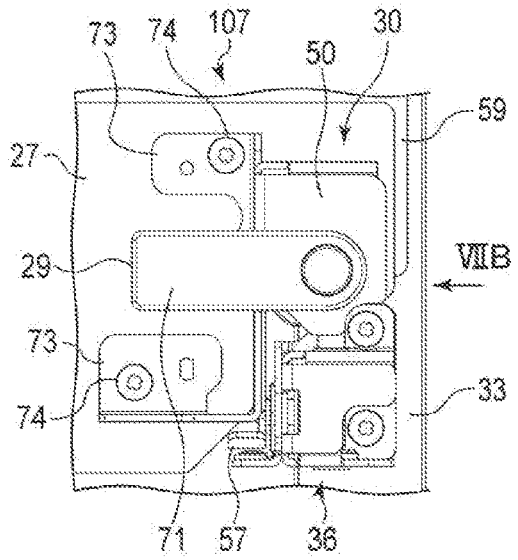
FIG. 7A, FIG. 7B, and FIG. 7C are explanatory views for illustrating operations of a lever portion and the support base portion caused when a lever is operated.

After that, the user rotates the regulation side plate unit 107 about the holding shafts 58 to raise the regulation side plate unit 107. Each of the levers 29 provided to the regulation side plate unit 107 has, in a part thereof, a pressing portion which allows the user to press the lever 29 toward the rear side in the drum axial direction X. In this embodiment, the lever 29 has a pressing surface 71 as the pressing portion as illustrated in FIG. 7A which is referred to later. The user grabs and pushes the lever 29 or presses the pressing surface 71 having a surface substantially parallel to the regulation side plate 27 on the front side of the lever 29, to thereby push the regulation side plate unit 107 toward the rear side of the apparatus main body 110 (FIG. 6B). In FIG. 6B, the position of the regulation side plate unit 107 with respect to the apparatus main body 110 corresponds to a disengagement position at which the drum bearing 32 is separated away from the drum shaft 31 and thus the drum cartridge 104 is insertable or removable.

When the regulation side plate unit 107 is further pushed toward the rear side of the apparatus main body 110, as illustrated in FIG. 6C, the front drum bearing 32 of the regulation side plate 27 is fitted to the drum shaft 31, and the positioning hole 49 for the regulation side plate 27 is fitted to the rotation stop shaft 48. Further, the urging force caused by the coupling spring 44 is received by the regulation side plate unit 107 due to the abutment portion (not shown) of the drum cartridge 104 abutting against the regulation side plate unit 107. The positions of the drum shaft 31 and the drum cartridge 104 which are each tilted in the gravity direction due to its own weight are corrected upward when the user fits the projecting portion 28 of the regulation side plate unit 107 to the positioning hole 35 against the urging force from the drum cartridge 104.

Those operations are required to be performed with large operation loads by the user. In view of the above, at a stage from the time before the projecting portion 28 is fitted to the positioning hole 35 to the time at which the fitting is started, the user operates the lever (operation portion) 29 of the lever portion 30 to engage the lever cam (engaging portion) 53 with the contact portion (engaged portion) 64. Through use of the urging force caused by the compression spring 54 as an assist, the user pushes the regulation side plate unit 107 up to a predetermined position to determine the position of the drum cartridge 104 (FIG. 6C). In FIG. 6C, the position of the regulation side plate unit 107 with respect to the apparatus main body 110 corresponds to a support position at which the drum bearing 32 supports the drum shaft 31.

FIG. 7A, FIG. 7B, FIG. 7C, FIG. 8A, FIG. 8B, FIG. 8C, FIG. 9A, FIG. 9B, and FIG. 9C are explanatory views for illustrating operations of the lever portion 30 and the support base portion 36 caused when the lever 29 is operated. With reference to FIG. 7A, FIG. 7B, FIG. 7C, FIG. 8A, FIG. 8B, FIG. 8C, FIG. 9A, FIG. 9B, and FIG. 9C, the operations of the lever portion 30 and the support base portion 36 caused when the right lever 29 of the image forming apparatus 1 is operated in order to position the regulation side plate unit 107 are described. Description of the operations of the lever portion 30 and the support base portion 36 caused when the left lever 29 of the image forming apparatus 1 is operated is omitted because the operations are bilaterally symmetric to the operations on the right side.

Figure 7B:
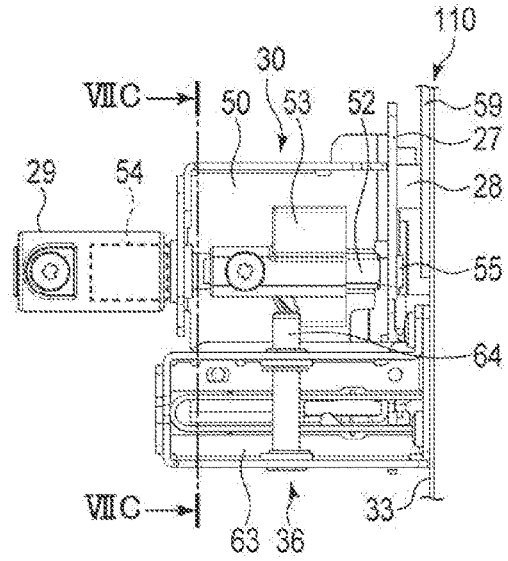
Figure 7C:
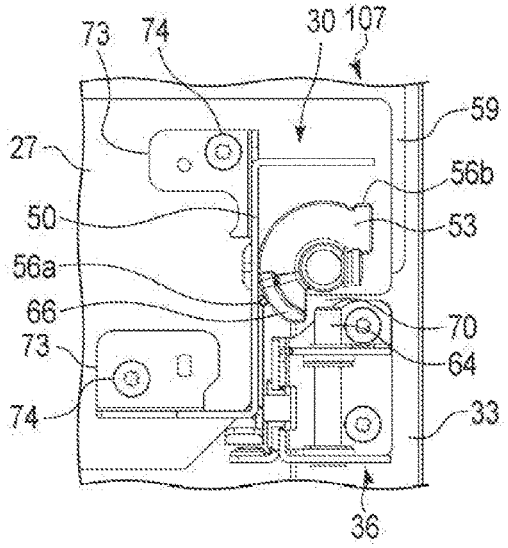

FIG. 7A is a front view of the lever portion 30 and the support base portion 36 at the time when the lever 29 is at a first lever angle. The longitudinal direction of the lever 29 at the first lever angle is substantially horizontal, and a tip end portion of the lever 29 is directed inward of the apparatus main body 110 in the right-and-left direction. FIG. 7B is a side view of the lever portion 30 and the support base portion 36 as viewed along the arrow VIIB of FIG. 7A. FIG. 7C is a sectional view of the lever portion 30 and the support base portion 36 taken along the line VIIC-VIIC of FIG. 7B.

The user presses the pressing surface 71 of the lever 29 while guiding the guide portion 57 of the regulation side plate unit 107 by the support base portion 36 of the apparatus main body 110, to thereby push the regulation side plate unit 107 into the apparatus main body 110. At this time, as illustrated in FIG. 7A, when the lever 29 is rotated so as to be horizontal, as illustrated in FIG. 7C, the first abutment portion 56*a* of the lever cam 53 abuts against the support plate 50, and thus the rotation position of the lever cam 53 is regulated. The rotation angle of the lever 29 at this time is referred to as "first lever angle."

At the first lever angle, the contact relief portion 70 of the lever cam 53 is located at a position corresponding to the contact portion 64 of the support base portion 36. As illustrated in FIG. 7C, as viewed from the front of the apparatus main body 110, a space of the contact relief portion 70 overlaps with the contact portion 64. In this manner, the lever cam 53 is brought into a non-contact state with respect to the contact portion 64. The user can move the regulation side plate unit 107 up to a position at which the projecting portion 28 of the regulation side plate unit 107 is fitted to the positioning hole 35 formed in the apparatus main body 110. At this time, the lever 29 is urged by the compression spring 54 in the forward direction of the apparatus main body 110, and the lever shaft 52 fixed to the lever 29 is moved toward the front side of the apparatus main body 110 until the lever shaft 52 reaches a position at which the retaining member 55 fixed to the rear end portion of the lever shaft 52 abuts against the regulation side plate 27.

Figure 8A:
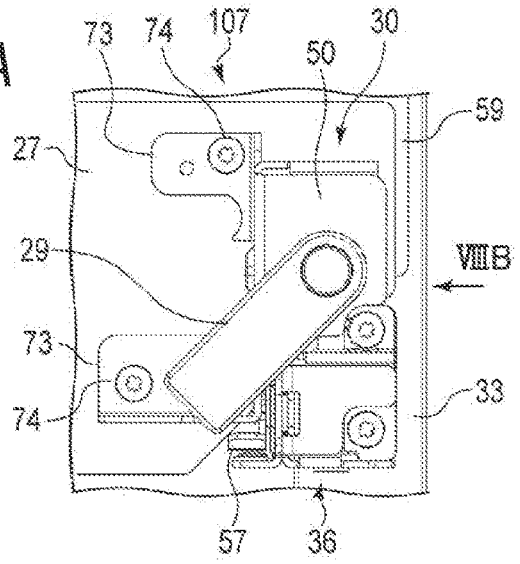
FIG. 8A, FIG. 8B, and FIG. 8C are explanatory views for illustrating operations of the lever portion and the support base portion caused when the lever is operated.
Figure 8B:
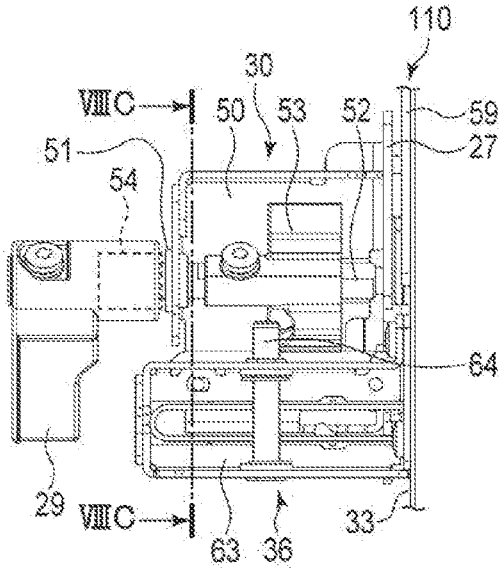
Figure 8C:
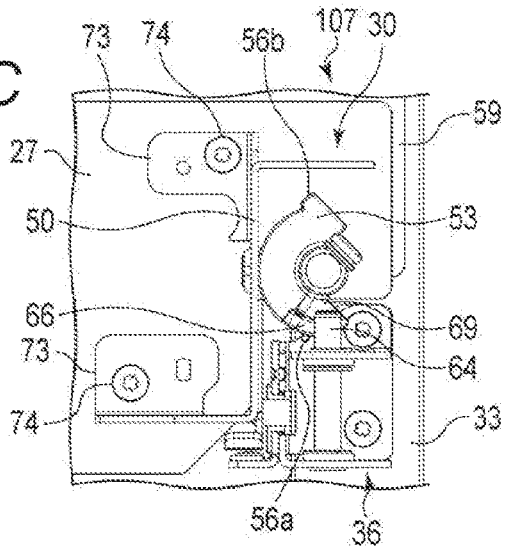

FIG. 8A is a front view of the lever portion 30 and the support base portion 36 at the time when the lever 29 is rotated to achieve a state in which the regulation side plate unit 107 is held by the support base portion 36. FIG. 8B is a side view of the lever portion 30 and the support base portion 36 as viewed along the arrow VIIIB of FIG. 8A. FIG. 8C is a sectional view of the lever portion 30 and the support base portion 36 taken along the line VIIIC-VIIIC of FIG. 8B. When the regulation side plate unit 107 is pushed toward the rear side of the apparatus main body 110 so that the lever cam 53 is located on the rear side of the apparatus main body 110 with respect to the contact portion 64, the user can rotate the lever 29 downward.

When the lever 29 is rotated to a downward position illustrated in FIG. 8A from the horizontal position illustrated in FIG. 7A, as illustrated in FIG. 8C, the first contact surface 66 of the lever cam 53 is brought into contact with the contact portion 64. The contact portion 64 is held by the support base 63 of the support base portion 36 so as to be immovable toward the front side of the apparatus main body 110, and hence the lever cam 53 is pressed and moved toward the rear side of the apparatus main body 110 by the contact portion 64 so that the compression spring 54 is compressed. In this manner, the compression spring 54 urges the support plate 50 toward the rear side of the apparatus main body 110 through intermediation of the lever bearing 51, and thus urges the regulation side plate unit 107 toward the rear side of the apparatus main body 110. As the lever 29 is rotated downward, the lever cam 53 is pushed toward the rear side of the apparatus main body 110, to thereby increase the urging force of the compression spring 54. The compression spring 54 pushes the regulation side plate unit 107 toward the rear side of the apparatus main body 110 with an urging force stronger than the resistance force caused when the projecting portion 28 is fitted to the positioning hole 35 and the urging force of the coupling spring 44 configured to urge the drum cartridge 104 to the front side.

The first contact surface 66 of the lever cam 53 against which the contact portion 64 is brought into abutment is formed of a helical surface. The angle of the inclination of the first contact surface 66 is increased as approaching the center side of the helical surface. The contact portion 64 is formed into a cylindrical shape. When the inclination of the helical surface of the first contact surface 66 becomes larger than the curvature of the cylinder of the contact portion 64, the contact portion 64 and the first contact surface 66 may be brought into contact with each other at unintended portions, to thereby cause reduction in durability by wearing or damage by stress concentration. Accordingly, the retreat surface 69 is formed on the center side with respect to the first contact surface 66. The lever cam 53 has the retreat surface 69, and hence the contact portion 64 can be reliably brought into abutment against the first contact surface 66.

Figure 9A:
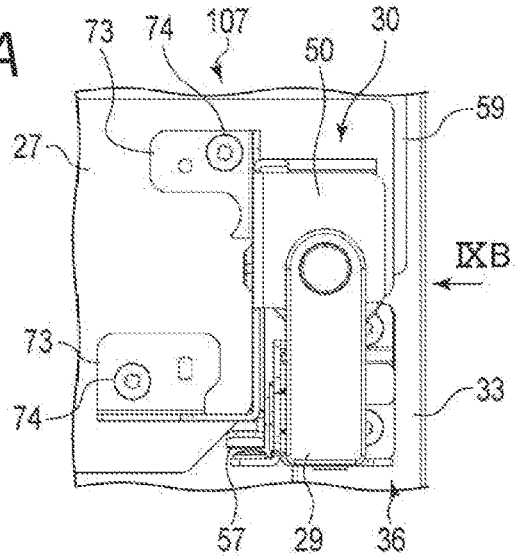
FIG. 9A, FIG. 9B, and FIG. 9C are explanatory views for illustrating operations of the lever portion and the support base portion caused when the lever is operated.
Figure 9B:
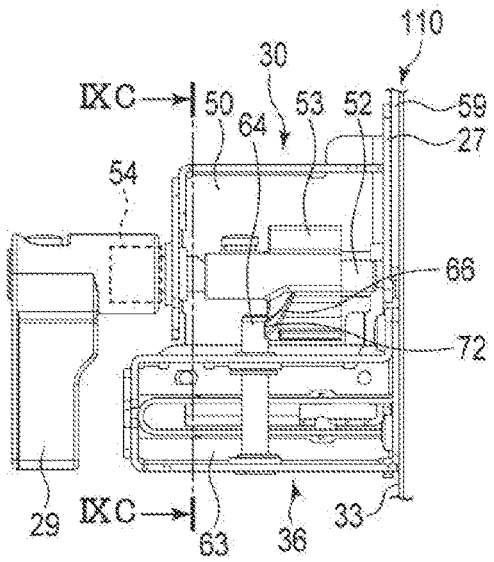
Figure 9C:
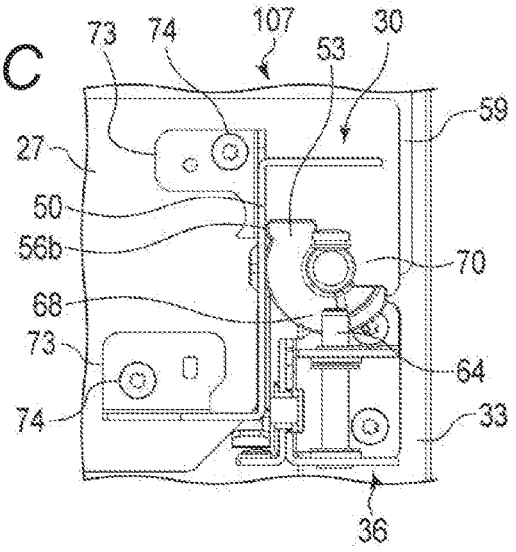

FIG. 9A is a front view of the lever portion 30 and the support base portion 36 at the time when the lever 29 is at a second lever angle. The longitudinal direction of the lever 29 at the second lever angle is substantially vertical, and the tip end portion of the lever 29 is directed downward of the apparatus main body 110. FIG. 9B is a side view of the lever portion 30 and the support base portion 36 as viewed along the arrow IXB of FIG. 9A. FIG. 9C is a sectional view of the lever portion 30 and the support base portion 36 taken along the line IXC-IXC of FIG. 9B.

At this time, as illustrated in FIG. 9A, when the lever 29 is rotated so as to be vertical, as illustrated in FIG. 9C, the second abutment portion 56*b* of the lever cam 53 abuts against the support plate 50, and thus the rotation position of the lever cam 53 is regulated. The rotation angle of the lever 29 at this time is referred to as "second lever angle."

At the second lever angle, as illustrated in FIG. 9C, the second contact surface 68 of the lever cam 53 is brought into abutment against the contact portion 64. When the second contact surface 68 of the lever cam 53 is brought into abutment against the contact portion 64, the lever cam 53 is positioned with respect to the apparatus main body 110. The compression spring 54 urges the regulation side plate unit 107 toward the rear side of the apparatus main body 110 with an urging force stronger than the urging force of the coupling spring 44 and the resistance force caused when the projecting portion 28 is fitted to the positioning hole 35 when the regulation side plate unit 107 is positioned. With the urging force of the compression spring 54, the regulation side plate 27 is brought into close contact with the front side plate 59, and the position of the regulation side plate 27 is regulated.

In this embodiment, the connecting portion 72 (FIG. 5A) connected to the first contact surface 66 is provided. As illustrated in FIG. 9B, in order that the connecting portion 72 is located on the front side of the apparatus main body 110 with respect to the second contact surface 68, the engagement surface 67 (FIG. 5A) having a slope opposite to the first contact surface 66 is formed between the connecting portion 72 and the second contact surface 68. When the user rotates the lever 29 to achieve the second lever angle, the connecting portion 72 rides on the contact portion 64 to cause a click feeling, and thus the user can recognize that a lock operation is finished. Further, in order to prevent the lever 29 from being rotated to cancel the positioning of the regulation side plate unit 107 when the user does not operate the lever 29, the engagement surface 67 is caught by the contact portion 64, thereby being capable of regulating the rotation of the lever 29.

Figure 10:
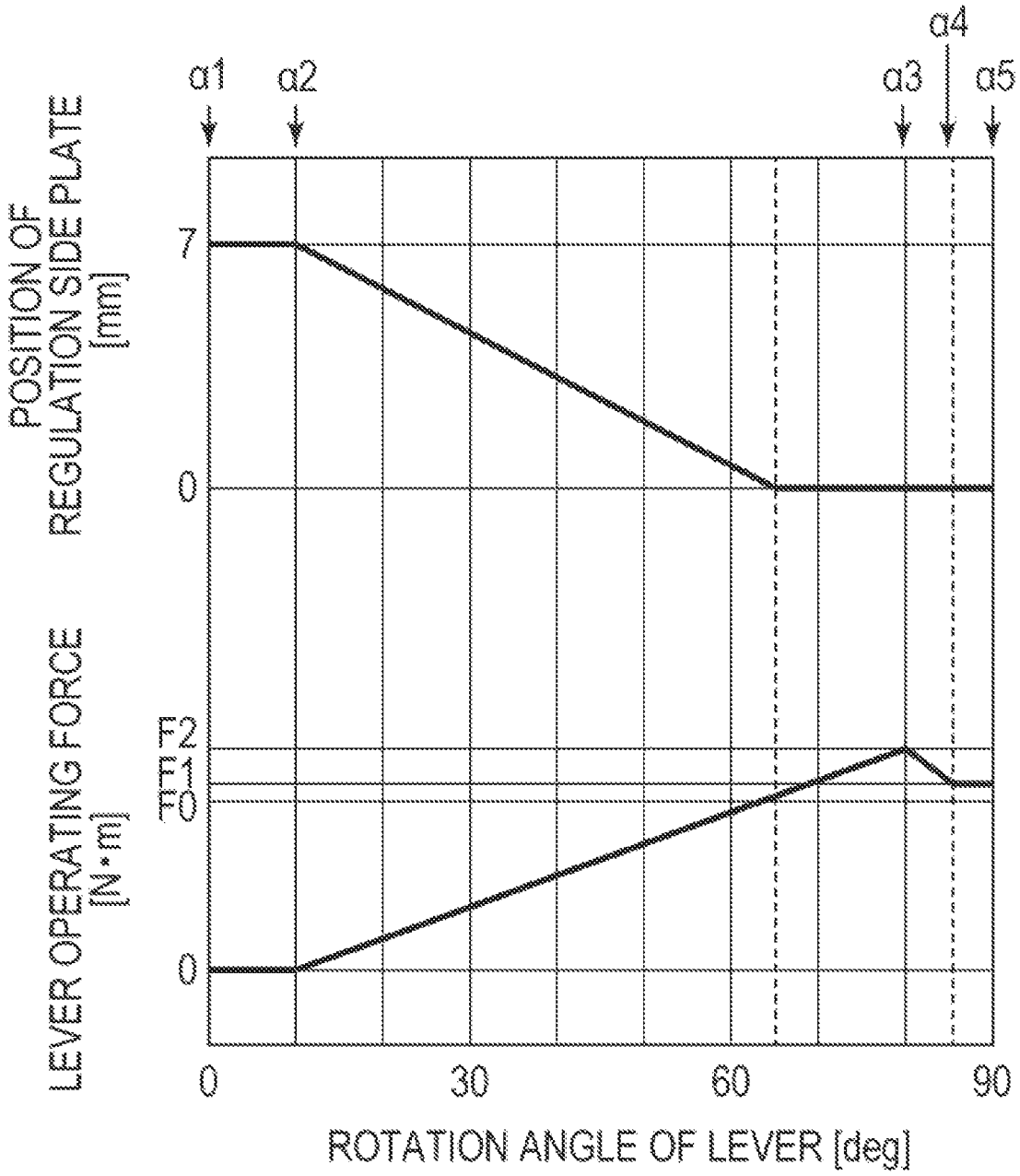
FIG. 10 is a graph for showing a lever operating force and a position of the regulation side plate unit with respect to a rotation angle of the lever.

FIG. 10 is a graph for showing a lever operating force and a position of the regulation side plate unit 107 with respect to a rotation angle of the lever. The lever operating force corresponds to a torque applied to the lever 29 by the user. The position of the regulation side plate unit 107 corresponds to a distance from the regulation side plate 27 to the front side plate 59. A lever rotation angle $\alpha 1$ corresponds to the first lever angle at which the lever 29 is horizontal, and the lever rotation angle α1 is set to 0°. At the lever rotation angle α1, the lever cam 53 is not brought into abutment against the contact portion 64, and hence the lever operating force is not generated. At a lever rotation angle α2, the first contact surface 66 of the lever cam 53 starts to abut against the contact portion 64 and thus the urging force is started to be generated by the compression spring 54, and hence the force of pushing the regulation side plate unit 107 toward the rear side of the apparatus main body 110 and the lever operating force are started to be generated.

At a lever rotation angle α3, the connecting portion 72 is brought into contact with the contact portion 64, and the lever operating force takes a maximum value F2. When, through the rotation of the lever 29, the connecting portion 72 passes by the contact portion 64 and the engagement surface 67 comes into contact with the contact portion 64, the lever operating force is reduced to cause a click feeling at the time of lever operation. A lever operating force having a value F1 larger than a value F0 required to determine the position of the regulation side plate unit 107 is applied to the lever 29 before the connecting portion 72 abuts against the contact portion 64, and hence the regulation side plate 27 is brought into contact with the front side plate 59 to determine the position of the regulation side plate unit 107 (0 mm).

At a lever rotation angle α4, the second contact surface 68 is brought into contact with the contact portion 64, and the lever operating force has the value F1. The second contact surface 68 is a flat surface, and hence the lever operating force is unchanged and still has the value F1 even at a second lever angle α5. With a play region being provided, even when a component tolerance varies, the second contact surface 68 can reliably abut against the contact portion 64. In a state in which the second contact surface 68 is in contact with the contact portion 64, the compression spring 54 urges the regulation side plate 27 toward the rear side of the apparatus main body 110.

When the set lever operating force is a heavy load for the user, the length of the lever 29 can be extended so that the force to be applied to the lever 29 by the user can be adjusted to be lower. However, when the lever 29 is extended, a rotation track (rotation range) of the lever 29 is increased. When the rotation track of the lever 29 is provided on the outer side of the image forming apparatus 1, an installation environment is restricted such that the image forming apparatus 1 cannot be installed at a place adjacent to a wall. Accordingly, it is preferred that the rotation track of the lever 29 be provided on the inward side of the image forming apparatus 1.

Further, in this embodiment, in a state in which the projecting portion 28 of the regulation side plate unit 107 and the positioning hole 35 are incompletely fitted to each other, the regulation side plate unit 107 is imparted with an urging force toward the rear side of the apparatus main body 110. In this embodiment, the urging force of the compression spring 54 is received by the support plate 50 including the support plate fixing portion 73 fixed to the regulation side plate 27 by the screw 74, and is thus imparted to the regulation side plate 27 via the support plate fixing portion 73.

Figure 11A:
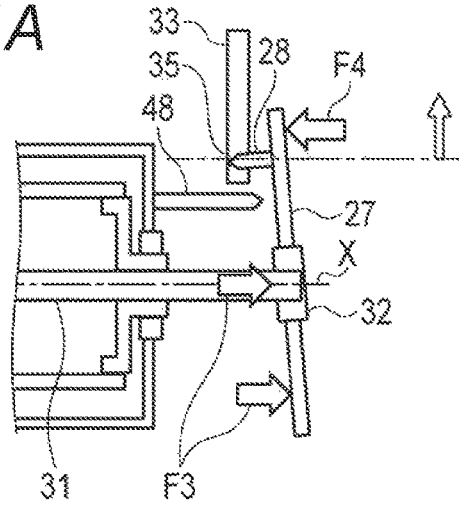
FIG. 11A, FIG. 11B, and FIG. 11C are explanatory views for illustrating an urging force and a reaction force to be imparted to a regulation side plate.
Figure 11B:
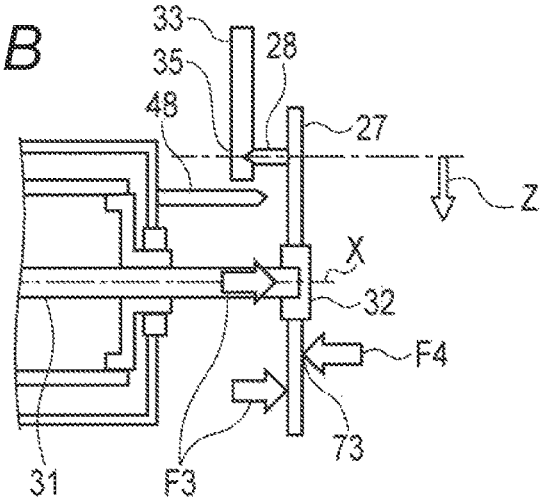
Figure 11C:
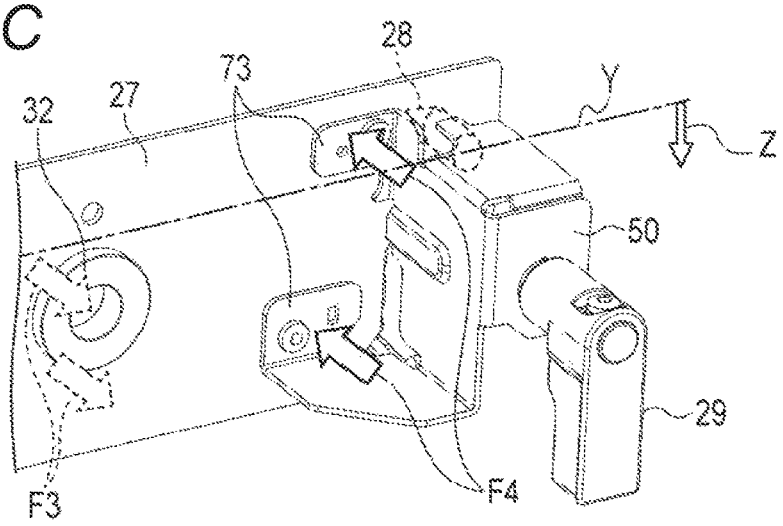

FIG. 11A, FIG. 11B, and FIG. 11C are explanatory views for illustrating an urging force F4 and a reaction force F3 to be imparted to the regulation side plate 27. In this case, the reaction force F3 is, for example, a reaction force received when a coupling for driving a screw (not shown) in the developing cartridge 105 is brought into abutment. As illustrated in FIG. 11C, when the second contact surface 68 abuts against the contact portion 64, the support plate fixing portion 73 imparts the urging force F4 to the regulation side plate 27 toward the rear side of the apparatus main body 110 in the drum axial direction X. At each of both end portions of the regulation side plate 27 in an array direction (hereinafter referred to as "drum array direction") Y of the plurality of photosensitive drums 4, at least one support plate fixing portion (urging force imparting portion) 73 is provided. In this embodiment, two support plate fixing portions 73 are provided at each of both end portions of the regulation side plate 27. At least one (at least a part) of the two support plate fixing portions 73 is provided on, with respect to the projecting portion 28, a side of the reaction force F3 received by the regulation side plate 27 from the apparatus main body 110, in a direction Z orthogonal to the drum array direction Y.

For example, as illustrated in FIG. 11A, there is considered a case in which the urging force F4 is imparted to the regulation side plate 27 on, with respect to the projecting portion 28 and the positioning hole 35, a side opposite to the side on which the reaction force F3 from the drum cartridge 104 and the developing cartridge 105 is received. In the case illustrated in FIG. 11A, the regulation side plate unit 107 is tilted about the projecting portion 28 and the positioning hole 35, and thus the axial direction of the drum bearing 32 is brought into a tilted state with respect to the axial direction of the drum shaft 31. This state may cause a resistance force due to the rubbing between the drum shaft 31 and the drum bearing 32 to cause positioning failure. When the positioning failure of the drum shaft is caused, the photosensitive drum 4 may not be able to rotate, or the photosensitive drum 4 may be rotated in a state in which the photosensitive drum 4 is tilted with respect to other photosensitive drums to cause image defects, for example, color misregistration. In view of the above, as illustrated in FIG. 11B and FIG. 11C, the at least one support plate fixing portion 73 is provided on, with respect to the projecting portion 28, the side on which the reaction force F3 from the drum shaft 31 is received, in the direction Z orthogonal to the drum array direction Y.

According to this embodiment, there can be provided a positioning configuration in which the regulation side plate unit 107 configured to regulate the positions of the photosensitive drums 4 is removably mounted and supported, thereby being capable of reducing a user operation load even while saving space, and also allowing the user to easily replace the drum cartridge 104.

In this embodiment, the lever 29 and the lever cam 53 are provided to the regulation side plate unit 107, and the contact portion 64 is provided to the apparatus main body 110. However, the contact portion 64 may be provided to the regulation side plate unit 107, and the lever 29 and the lever cam 53 may be provided to the apparatus main body 110. Further, in this embodiment, the compression spring 54 is provided on the lever shaft 52, and the contact portion 64 is provided to the apparatus main body 110 so as to be immovable in the front-and-rear direction. However, the lever portion 30 may be regulated in thrust position on the regulation side plate unit 107 so as to be immovable in the front-and-rear direction of the apparatus main body 110, and the contact portion 64 may be urged toward the rear side of the apparatus main body 110 by an elastic member. The regulation side plate unit 107 may be urged toward the rear side of the apparatus main body 110 by the contact portion 64 urging the lever cam 53 toward the rear side of the apparatus main body 110.

In this embodiment, the lever shaft (engaging portion rotation shaft) 52 of the lever 29 to be operated to fix the regulation side plate 27 to the apparatus main body 110 is arranged parallel to the drum shaft 31. When the rotation track (rotation range) of the lever (operation portion) 29 falls within a predetermined range on the inward side of the apparatus main body 110, the user load at the time of work of replacing the drum cartridge 104 can be reduced while the dimension (size) of the apparatus main body 110 is reduced. In this embodiment, the term "parallel" includes a state in which the lever shaft 52 and the drum shaft 31 are brought into a tilted state within a range of the component tolerance.

According to this embodiment, while the space required for the rotation track of the lever 29 for operating the lever cam 53 for fixing the regulation side plate 27 to the apparatus main body 110 is reduced, the user operating force against the reaction force caused when the regulation side plate 27 is positioned and the resistance force caused when the axial direction of the drum shaft 31 deviates from the axial direction of the drum bearing 32 can be reduced. According to this embodiment, the regulation side plate 27 configured to position the drum shafts 31 of the photosensitive drums 4 can be easily fixed to the apparatus main body 110.

According to this embodiment, the regulation side plate configured to position the drum shafts of the photosensitive drums can be easily fixed to the apparatus main body.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-094128, filed May 29, 2020 which is hereby incorporated by reference herein in its entirety.

What is claimed is:

1. An image forming apparatus configured to form an image onto a recording medium, the image forming apparatus comprising:

an apparatus main body;

a plurality of drum shafts supported by the apparatus main body;

a plurality of drum cartridges where each drum cartridge includes a photosensitive drum and is insertable and removable in an axial direction of a corresponding one of the plurality of drum shafts;

a regulation side plate which includes a plurality of bearings configured to support end portions of the plurality of drum shafts opposite to end portions of the plurality of drum shafts supported by the apparatus main body, and is to be fixed to the apparatus main body;

a cam including a first contact surface and a second contact surface;

an operation portion configured to rotatably operate the cam;

a shaft which is rotatably provided to the regulation side plate, and to which the operation portion and the cam are fixed;

a contact portion which is provided to the apparatus main body, and is configured to be brought into contact with the first contact surface and the second contact surface of the cam by rotation of the cam along with an operation of the operation portion;

a projecting portion provided to one of the regulation side plate and the apparatus main body;

a fitting portion which is provided to another one of the regulation side plate and the apparatus main body, and is to be fitted to the projecting portion; and an urging force imparting portion which is provided at each of both end portions of the regulation side plate in an array direction of the plurality of bearings, and is configured to impart, to the regulation side plate, an urging force that urges the regulation side plate toward the apparatus main body in a state in which the second contact surface is in contact with the contact portion by the operation portion being rotated by a user, wherein at least a part of the urging force imparting portion is provided at a position for imparting the urging force on, with respect to the plurality of bearings, a side opposite to a position at which one of the projecting portion and the fitting portion is provided, in a direction orthogonal to the array direction of the plurality of bearings and the axial direction of each of the plurality of drum shafts.

2. The image forming apparatus according to claim 1, wherein the contact portion has a cylindrical shape, and is rotatably provided to the apparatus main body.

3. The image forming apparatus according to claim 1, wherein the contact portion is fixed to the apparatus main body so as to be immovable in the axial direction of each of the plurality of drum shafts.

4. The image forming apparatus according to claim 1, wherein the second contact surface is a flat surface intersecting with an axial direction of the rotatably provided shaft.

5. The image forming apparatus according to claim 1, wherein the first contact surface is helically inclined in an axial direction of the rotatably provided shaft.

6. The image forming apparatus according to claim 5, wherein, in a rotation direction of the cam, the cam has, between the first contact surface and the second contact surface, an inclined surface inclined toward a side opposite to the first contact surface, and wherein the first contact surface, the cam inclined surface, and the second contact surface are continuous.

7. The image forming apparatus according to claim 1, wherein the operation portion includes a lever configured to rotate about the rotatably provided shaft serving as a rotation center, and wherein a rotation range of the lever is provided on an inward side of the image forming apparatus in a width direction of the image forming apparatus orthogonal to the axial direction of each of the plurality of drum shafts and the array direction of the plurality of bearings.

8. The image forming apparatus according to claim 7, wherein, by the lever being rotated, the cam is rotatable from a position at which the cam is out of contact with the contact portion to a position at which the first contact surface is in contact with the contact portion, wherein, in the width direction of the image forming apparatus, a tip end portion of the lever on a side opposite to the rotatably provided shaft in a state in which the contact portion and the second contact surface are in contact with each other is positioned at the same position as the rotatably provided shaft, and wherein, in the width direction of the image forming apparatus, the tip end portion of the lever on the side opposite to the rotatably provided shaft in a state in which the contact portion is out of contact with the cam is positioned on an inner side of the image forming apparatus with respect to the rotatably provided shaft.

9. An image forming apparatus configured to form an image onto a recording medium, the image forming apparatus comprising:

an apparatus main body;

a plurality of drum shafts supported by the apparatus main body;

a plurality of drum cartridges where each drum cartridge includes a photosensitive drum and is insertable and removable in an axial direction of a corresponding one of the plurality of drum shafts;

a regulation side plate which includes a plurality of bearings configured to support end portions of the plurality of drum shafts opposite to end portions of the plurality of drum shafts supported by the apparatus main body, and is to be fixed to the apparatus main body;

a cam including a first contact surface and a second contact surface;

an operation portion configured to rotatably operate the cam;

a shaft which is rotatably provided to the apparatus main body, and to which the operation portion and the cam are fixed;

a contact portion which is provided to the regulation side plate, and is configured to be brought into contact with the first contact surface and the second contact surface of the cam by rotation of the cam along with an operation of the operation portion;

a projecting portion provided to one of the regulation side plate and the apparatus main body;

a fitting portion which is provided to another one of the regulation side plate and the apparatus main body, and is to be fitted to the projecting portion; and an urging force imparting portion which is provided at each of both end portions of the regulation side plate in an array direction of the plurality of bearings, and is configured to impart, to the regulation side plate, an urging force that urges the regulation side plate toward the apparatus main body in a state in which the second contact surface is in contact with the contact portion by the operation portion being rotated by a user, wherein at least a part of the urging force imparting portion is provided at a position on, with respect to the plurality of bearings, a side opposite to a position at which one of the projecting portion and the fitting portion is provided, in a direction orthogonal to the array direction of the plurality of bearings and the axial direction of each of the plurality of drum shafts.

10. The image forming apparatus according to claim 9, wherein at least a second part of the urging force imparting portion is provided on, with respect to the projecting portion, a side on which the regulation side plate receives a reaction force from the apparatus main body when the regulation side plate is fixed to the apparatus main body, in a direction orthogonal to the array direction of the plurality of bearings.

11. The image forming apparatus according to claim 9, wherein the contact portion has a cylindrical shape, and is rotatably provided to the apparatus main body.

12. The image forming apparatus according to claim 9, wherein the contact portion is fixed to the apparatus main body so as to be immovable in the axial direction of each of the plurality of drum shafts.

13. The image forming apparatus according to claim 9, wherein the second contact surface is a flat surface intersecting with an axial direction of the rotatably provided shaft.

14. The image forming apparatus according to claim 9, wherein the first contact surface is helically inclined in an axial direction of the rotatably provided shaft.

15. The image forming apparatus according to claim 14, wherein, in a rotation direction of the cam, the cam has, between the first contact surface and the second contact surface, an inclined surface inclined toward a side opposite to the first contact surface, and wherein the first contact surface, the cam inclined surface, and the second contact surface are continuous.

16. The image forming apparatus according to claim 9, wherein the operation portion includes a lever configured to rotate about the rotatably provided shaft serving as a rotation center, and wherein a rotation range of the lever is provided on an inward side of the image forming apparatus in a width direction of the image forming apparatus orthogonal to the axial direction of each of the plurality of drum shafts and the array direction of the plurality of bearings.

17. The image forming apparatus according to claim 16, wherein, by the lever being rotated, the cam is rotatable from a position at which the cam is out of contact with the contact portion to a position at which the first contact surface is in contact with the contact portion, wherein, in the width direction of the image forming apparatus, a tip end portion of the lever on a side opposite to the rotatably provided shaft in a state in which the contact portion and the second contact surface are in contact with each other is positioned at the same position as the rotatably provided shaft, and wherein, in the width direction of the image forming apparatus, the tip end portion of the lever on the side opposite to the rotatably provided shaft in a state in which the contact portion is out of contact with the cam is positioned on an inner side of the image forming apparatus with respect to the rotatably provided shaft.

* * * * *